United States Patent [19]

Griffith et al.

[11] 4,257,432

[45] Mar. 24, 1981

[54] METERING DEVICE FOR FLAKED AND GRANULAR SOLIDS

[76] Inventors: Denis J. Griffith, 2412 Punta Del Este; Scott M. Reddy, 1502 Elk Lane Dr., both of Hacienda Heights, Calif. 91745

[21] Appl. No.: 42,561

[22] Filed: May 25, 1979

[51] Int. Cl.[3] ..... A24F 1/30; A24F 1/26

[52] U.S. Cl. ..... 131/173; 131/181; 131/226; 221/190; 222/162

[58] Field of Search ..... 131/173, 180, 181, 226; 221/190; 222/162, 160

[56] References Cited

U.S. PATENT DOCUMENTS

| | | | |
|---|---|---|---|
| 2,878,963 | 3/1959 | Bucci et al. | 221/190 |
| 3,130,862 | 4/1964 | Lachance | 221/190 X |
| 4,044,781 | 8/1977 | Heggestuen | 131/173 |

*Primary Examiner*—Stephen C. Pellegrino

[57] ABSTRACT

A metering device for granular and flaky materials is provided, comprising a bowl cavity member defining an upwardly facing metering cavity with an upper rim, an outlet passage extending from the metering cavity, and a hopper member movably mounted on the bowl cavity member and defining an upwardly facing material cavity. With the hopper member in its upper limit position the lower portion of its cavity is adjacent to the rim of the metering cavity, whereby material is moved by gravity into the material cavity from the hopper cavity, and with the hopper member in its lower limit position the metering cavity rim is substantially above the material in the hopper cavity. Thus, by moving the hopper member first to its upper limit position material from the hopper cavity fills the metering cavity, and by then moving the hopper member to its lower limit position the metering cavity rim is substantially above the material in the hopper cavity, whereby the metering cavity is automatically filled and isolated from the hopper cavity supply to provide the desired quantity in the metering cavity. In a preferred embodiment, the metering cavity is used as a pipe bowl used in conjunction with a water pipe or the like.

10 Claims, 4 Drawing Figures

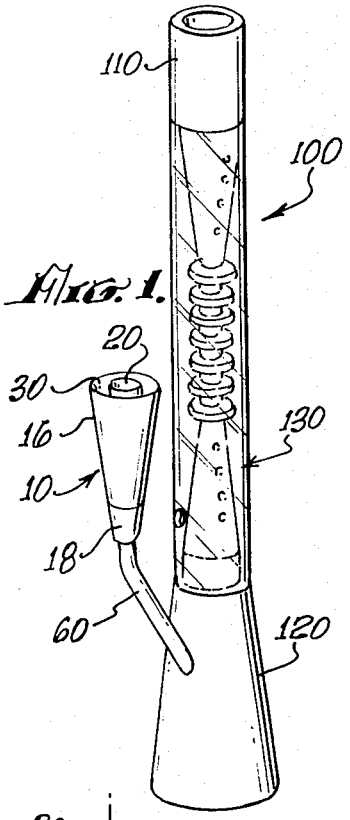
Fig. 1.
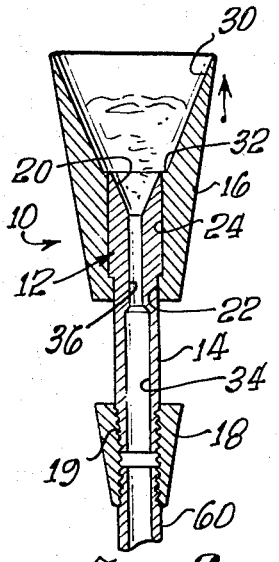
Fig. 3.
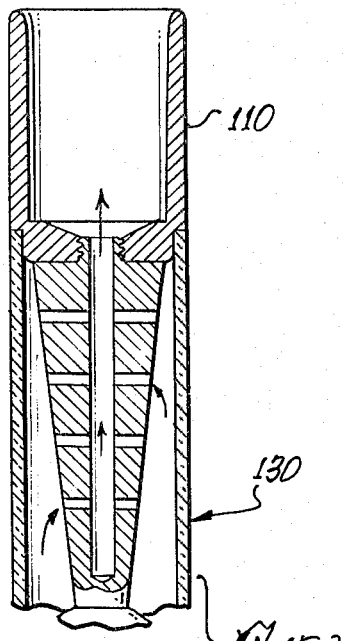
Fig. 2.
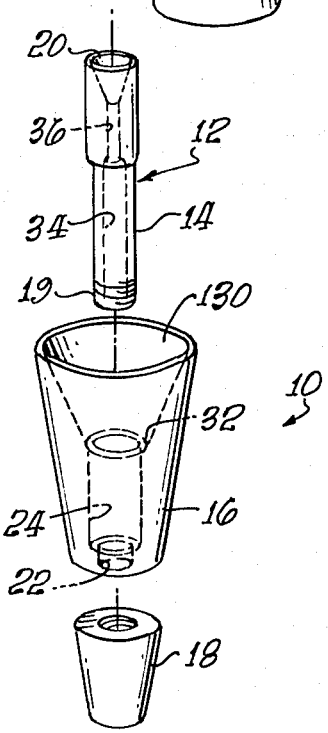
Fig. 4.
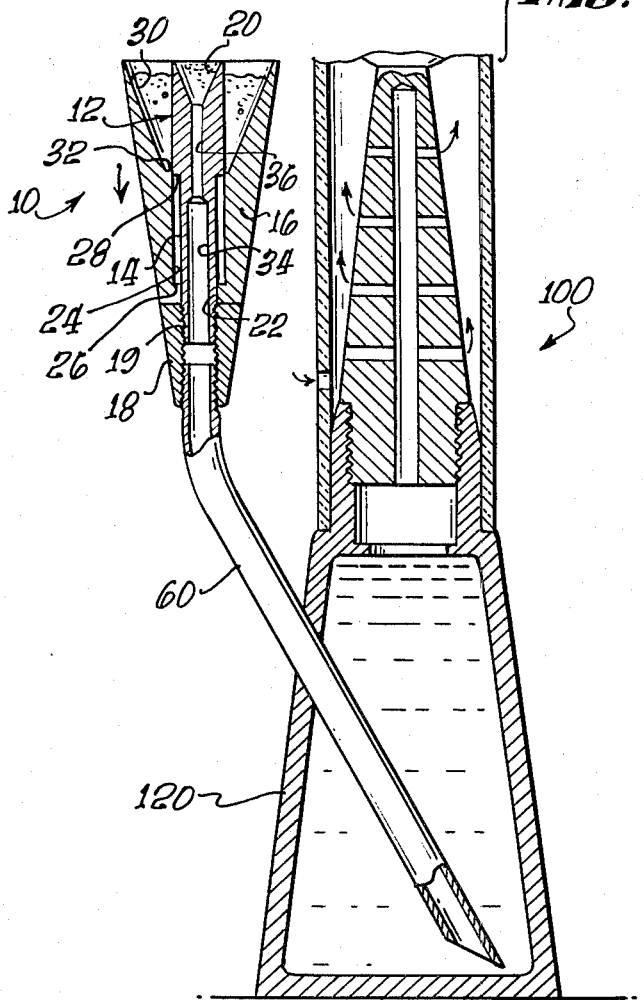

METERING DEVICE FOR FLAKED AND GRANULAR SOLIDS

BACKGROUND OF THE INVENTION

The present invention relates generally to metering devices for granular and flaky materials, and more particularly to a metering device wherein a metering cavity is filled with a predetermined quantity or dose of material by a movable hopper member which in its upper position causes material to move by gravity into the metering cavity and which in its lower position positions material in the hopper cavity below the rim of the metering cavity.

In many metering and measuring applications, and particularly in measuring material used with water pipes known as narghiles or hookahs, it is required for proper use that a particular quantity or measure of flaky or granular material, such as tobacco, be metered into a pipe bowl at frequent intervals for burning. This has long been done manually by pouring the material into a measuring cup or device from a separate container. Such procedures are tedious, inaccurate, inconvenient, and require a separate, movable container for decanting material which is not readily pourable because of inter-granular friction and the consistency of the materials.

Typical prior art devices depend upon discharge of flaked or granular material from the base of a hopper into a measuring cavity by the opening of a valve, or by reciprocation of a slider having a measuring cavity into and out of registration with a hopper base, as shown in U.S. Pat. No. 4,044,781 to Heggestuen. Such devices are characterized by certain shortcomings, including unreliability because of internal inter-granular friction of the flaked or granular substances, such as shredded tobacco, which do not readily flow by gravity, and which may not fill the measuring cavity upon the opening of the hopper base thereto.

It is therefore an object of the present invention to provide metering means for filling upwardly facing metering cavities with flaky or granular material, wherein flow of material from a free surface into measuring cavity overcomes difficulties inherent in the inter-granular friction and consistency of such materials.

It is an object of the invention to provide a metering device for use with water pipes and the like, wherein the tobacco or herb to be smoked is supplied from a material cavity of a movable hopper which in its upper limit position causes material to flow by gravity into a bowl metering cavity, and when moved into its lower position has the material therein below the rim of the metering cavity.

SUMMARY OF THE INVENTION

The foregoing objects, and other objects and advantages which will become apparent from the detailed description of the preferred embodiment, are attained in a metering device for granular and flaky materials comprising a bowl cavity member having a head portion defining an upwardly facing metering cavity with an upper rim, an outlet passage extending from the metering cavity, and a hopper member slidably mounted on the bowl cavity member and defining an upwardly facing material cavity, preferably of frustro-conical configuration. Upper and lower stop means establish an upper hopper limit position and a lower hopper limit position. With the hopper in its upper limit position, the lower portion of the hopper material cavity is adjacent the rim of the metering cavity, so that material from the hopper cavity moves by gravity into the metering cavity, both cavities preferably being defined by frustro-conical walls which cooperate to define a substantially continuous wall when the hopper is in its upper limit position, thus to facilitate movement of material into the metering cavity. With the hopper then moved to its lower limit position, the metering cavity rim is substantially above the lower portion of the hopper cavity and above the material in the hopper cavity. The metering cavity is thus automatically filled with the desired quantity of material, as determined by the cavity capacity, simply by movement of the hopper member first to its upper limit position, then to its lower limit position.

The hopper member is preferably slidably mounted on the bowl cavity member, and its upper limit position is preferably set by engagement of an annular shoulder on the bowl cavity member with an annular shoulder of the hopper. The lower limit position of the hopper is preferably established by engagement of a downwardly facing surface of the hopper engaging an upwardly facing surface of a support fitting mounted on the outer end portion of a conduit which defines the outlet passage from the metering cavity. An orifice is preferably provided between the metering cavity and the outlet passage in order to prevent passage of material while permitting passage of gases and fine material or residue.

With the metering device of the invention utilized with a water pipe, narghile or the like, the metering cavity serves as a pipe bowl for the burning of material smoked by means of the water pipe, the water pipe having a water chamber and a mouthpiece extending above the water chamber. The outlet passage from the metering cavity connects the metering cavity with the water chamber. The orifice between the metering cavity and the passage prevents the passage of flaked tobacco or herb, while permitting passage of gases and ashy residue. An annular shoulder is preferably provided in the lower portion of the hopper material cavity to prevent intrusion of the granular or flaky material between the hopper member and the adjacent bowl cavity member, in order to prevent binding between these members.

In utilizing the metering device for other purposes, the outlet passage from the metering cavity may serve to discharge the metered charge or dose of material therefrom, by operation of an appropriate valve or gate which serves to prevent discharge of material during the filling process. Movement of the hopper member may be utilized to effect opening and closing of the valve or gate automatically, thus closing it when the hopper is in its upper position, and opening it when the hopper is in its lower position.

BRIEF DESCRIPTION OF THE DRAWING

FIG. 1 is a perspective view of a metering device of the invention mounted for operation with a water pipe;

FIG. 2 is an enlarged elevational sectional view of the metering device and water pipe of FIG. 1;

FIG. 3 is an enlarged sectional partial view of the metering device of FIGS. 1 and 2, showing the metering device with its hopper member in its upper limit position; and FIG. 4 is an exploded perspective view of the metering device of FIGS. 1 to 3.

DESCRIPTION OF THE PREFERRED EMBODIMENT

FIGS. 1 and 4 illustrate a metering device 10 according to the invention in association with a water pipe 100 of the type known as a hookah or narghile, the metering device being mounted at the end of a conduit member 60 interconnected with a water chamber 120 of the pipe, which has an upwardly extending mouthpiece 110 and a filter assembly 130 between the water chamber and mouthpiece.

A frusto-conical metering cavity 20 is defined in the outer portion of a bowl cavity member 12 which has a large outer head portion, a reduced portion 14, and a threaded end portion 19. A restricted orifice 36 is defined in the bowl cavity member between the metering cavity and a passage 34 in the head member and in conduit 60, thus to prevent passage of flaked or granular material while permitting passage of air, combustion products and ashy residue.

A frusto-conical support fitting 18 has an axial bore threadedly engaging the end portion of conduit 60 and the lower end portion of the bowl cavity member 12.

A hopper member 16 defines an upwardly facing material cavity 30 having a frustro-conical configuration terminating in an annular transverse shoulder 32, and having an axial bore 24 and a reduced opening 22.

The bowl cavity member head portion and its reduced portion 14 are adapted and configurated to be slidably received in the bore 24 and in the reduced opening 22, respectively, of the hopper member. As shown in FIGS. 3 and 4, the hopper 16 normally seats on the upper surface of support fitting 18, this being the lower limit position of the hopper, wherein its upper rim is at the level of the upper lip of the metering cavity 20.

The annular shoulder 32 of the hopper member is disposed about the head portion of the bowl cavity member 12, and serves to stabilize or retain the lowermost particles or flakes of material in the hopper cavity 30, and to prevent their ingress into any clearance space between the bowl cavity member 12 and the wall of bore 24 of the hopper, which could cause interference and binding of the hopper relative to the bowl cavity member.

In the utilization of the metering device of the invention, as with pipe 100, the hopper cavity 30 is charged with flaked or granular material, such as tobacco. The metering cavity 20 serves as a combustion bowl for the pipe, and is adapted to accommodate an appropriate quantity of tobacco or flaked material for smoking.

Upward displacement of the hopper 16 to its upper limit position, limited by engagement of its internal shoulder 26 with shoulder 28 of the head member, positions the free surface of the material in hopper cavity 30 well above the lip of metering cavity 20, so that the granules or flakes of material flow or fall by gravity into the metering cavity 20.

The hopper is then lowered to its lower limit position of FIG. 2, determined by seating of its lower downwardly facing surface on the upwardly facing surface of support fitting 18, wherein the rim of the metering cavity 20 is positioned well above the free surface of the material in hopper cavity 30. Any material which does not fall into the cavity 30 and remains humped over the rim of cavity 20 can readily be struck off and caused to fall into the hopper cavity.

When the material in metering cavity 20 has been utilized or exhausted, the charging process may be repeated by raising the hopper member 16 to its upper limit position, then lowering it again to its lower limit position, thus refilling the metering cavity 20.

Oral suction at the end portion of mouthpiece 110 reduces the pressure in filter assembly 130 to draw air through the ignited material mass in metering cavity 20. Flow of air through the material in the metering cavity causes an increased rate of combustion, whereby the gaseous and liquid products of the combustion pass through conduit 60 into the water in chamber 120, where condensible components are scrubbed out and gaseous combustion products rise through filter assembly 130, and thence outwardly through mouthpiece portion 110. The filter assembly provides further cleansing of the stream via multiple turning paths and cool surfaces for deposition of condensible matter, including water entrained from the chamber 120.

Although a preferred embodiment of the invention is herein described as appropriate for use in the accurate metering of charges of flaked or granular materials, other embodiments may readily be employed for analogous metering tasks for granular materials of different characteristics, the principal feature of the invention in all its applications being the charging of a defined volume from above and from the upper free portion of a mass of material to be metered, followed by lowering of the free surface of the material below the rim of a metering cavity.

The inventors claim:

1. A metering device for granular and flaky materials, comprising:

a bowl cavity member defining an upwardly facing metering cavity having an upper rim, said cavity being configurated and sized to meter a predetermined quantity of such materials, means defining an open passage extending from the metering cavity for passage of finely divided material therethrough, a hopper member movably mounted on the bowl cavity member and defining an upwardly facing material cavity, upper stop means establishing an upper hopper limit position wherein the lower portion of the hopper material cavity is adjacent to the rim of said metering cavity, and lower stop means establishing a lower hopper limit position wherein the rim of the metering cavity is substantially above said lower portion of the hopper material cavity and the level of material in the hopper material cavity, whereby with the hopper in its upper limit position material therein is moved by gravity into the metering cavity and with the hopper moved to its lower limit position the rim of the metering cavity is above the material in the hopper.

2. A metering device according to claim 1, wherein:

the metering cavity serves as a pipe bowl for burning material smoked with a water pipe having a water chamber and a mouthpiece thereabove, and said passage interconnects the metering device and the water chamber.

3. A metering device according to claim 1 or claim 2, and further including:

means defining an orifice between the metering cavity and said passage, said orifice being configurated and sized to prevent passage of flaky and granular material therethrough while allowing passage of gases and fine material.

4. A metering device according to claim 1 or claim 2, wherein:

a conduit member defines said passage extending from the metering cavity, and the bowl cavity member is at the outer end portion of the conduit member and has a head portion defining said metering cavity.

5. A metering device according to claim 1 or claim 2, wherein:

the hopper member is slidably mounted on the bowl cavity member for movement between its first and second limit positions.

6. A metering device according to claim 1 or claim 5, wherein:

said upper hopper position limit means comprises an annular shoulder on the bowl cavity member and a cooperating annular shoulder in the lower portion of the hopper.

7. A metering device according to claim 4 or claim 5 or claim 6, and further including:

a support fitting mounted on the outer end portion of said conduit member and having an upwardly facing surface engagable with a downwardly facing surface of the hopper to define said lower limit position.

8. A metering device according to claim 7, wherein:

said support fitting is threadedly secured between the bowl cavity member and the conduit member.

9. A metering device according to claim 1 or claim 2 or claim 5, wherein:

said metering cavity is defined by a frustro-conical wall, and the hopper material cavity has a frustro-conical wall, said hopper cavity wall and said metering cavity wall cooperating to define a substantially continuous wall when the hopper is in its upper limit position, whereby material in the hopper cavity moves by gravity into the metering cavity.

10. A metering device according to claim 5, wherein:

an annular shoulder is defined in the lower portion of the hopper material cavity about the bowl cavity member to prevent intrusion of the granular or flaky material between the hopper member and the bowl cavity member to prevent binding therebetween.

* * * * *